US005316296A

United States Patent [19]

Ben-Zirma et al.

[11] Patent Number: 5,316,296

[45] Date of Patent: May 31, 1994

[54] SHOCK-ABSORBING GAME RACKET

[76] Inventors: Liora B. Ben-Zirma, Rehov Cordova 5, Tel-Aviv; Yoram Levanon, Rehov Szold 44, Ramat Hasharon; Samuel Ronen, Rehov Golomb 2a, Herzliya, all of Israel

[21] Appl. No.: 57,057

[22] Filed: May 5, 1993

[51] Int. Cl.[5] ..... A63B 49/00

[52] U.S. Cl. ..... 273/73 R; 273/73 G; 273/76; 273/29 A

[58] Field of Search ..... 273/73 R, 73 C, 73 D, 273/73 G, 76, 67 R, 29 R, 29 A, 30, DIG. 26

[56] References Cited

U.S. PATENT DOCUMENTS

| | | | |
|---|---|---|---|
| 4,079,935 | 3/1978 | Gormley | 273/67 R |
| 4,101,132 | 7/1978 | Conrey et al. | 273/73 R X |
| 4,189,142 | 2/1980 | de Vries | 273/73 D |
| 4,320,900 | 3/1982 | Blackburne | 273/73 D |
| 4,822,042 | 4/1989 | Landsman | 273/73 R |
| 5,031,909 | 7/1991 | Pecker | 273/73 R X |

FOREIGN PATENT DOCUMENTS

| | | | |
|---|---|---|---|
| 2942533 | 4/1981 | Fed. Rep. of Germany | 273/73 R |
| 2513752 | 4/1983 | France | 273/73 R |
| 2525114 | 10/1983 | France | 273/76 |
| 2626481 | 8/1989 | France | 273/73 R |
| 2250923 | 6/1992 | United Kingdom | 273/73 R |

OTHER PUBLICATIONS

Advertisement for Harvard Table Tennis, The Sporting Goods Dealer, Jun. 1976, p. 53.

*Primary Examiner*—Vincent Millin
*Assistant Examiner*—Releigh W. Chiu
*Attorney, Agent, or Firm*—Edward Langer

[57] ABSTRACT

An energy-absorbing game racket designed as a pair of planar surfaces extending from a handle constructed as a sandwich design within a frame, with a set of coil springs compressed within the space defined between opposing surfaces. One of the surfaces is mounted to move within the frame against the springs such that it has a springy characteristic, while the other surface is stiff. In a racket ball game volley, either surface may be directed so that the ball impacts it. When the springy surface is directed toward the ball, it partially absorbs the impact force thereof, while the stiff surface does not. This design enhances the player's ball control options in delivering the return volley. An additional feature of the inventive game racket is the provision of an audio indication associated with impact of the ball on a particular area of the racket surface. A lamp and counter may also be provided for this purpose. By designating a particular area of the racket surface as the target, a player's expertise in achieving ball control accuracy can be measured. The inventive racket affords an additional level of competitiveness to the existing racket ball sport, enabling development of new games with new play strategies and point scoring schemes. For example, if a targeted area of the racket has been designated, this may be used to provide a ball control accuracy measurement, with a player scoring extra points for each target hit recorded by the counter and/or the audio-visual signal.

15 Claims, 4 Drawing Sheets

SHOCK-ABSORBING GAME RACKET

FIELD OF THE INVENTION

The present invention relates to sporting equipment, games and the like, and more particularly, to a shock-absorbing game racket for use in a competitive hit-and-return ball game.

BACKGROUND OF THE INVENTION

A known and popular sporting game known as racket ball or a variation thereof involves the use of a game ball which is maintained in a volley between players each of whom uses a racket to hit and return the ball to the other player. The ability of the players to maintain a continuous volley depends on their skill in returning the ball directed at them. When the ball is hit in a very direct and hard fashion at the opposing player, he is generally unable to control the ricochet of the ball impacting his racket, so that he cannot return it, and the volley is interrupted. Thus, the skill of the game is dependent on hitting the ball with target precision and with the appropriate force, so that it hits the opposing player's racket.

The currently available game racket equipment is not designed to compensate for the force of the ball impacting the racket, thus limiting the player's ball control options.

Therefore, it would be desirable to provide a shock-absorbing game racket which enhances the player's ball control options, enabling him to control the ball return force.

SUMMARY OF THE INVENTION

Accordingly, it is a principal object of the present invention to overcome the disadvantages of existing game rackets and provide a novel shock-absorbing game racket for a racket ball game which enables the user to control the ball return force.

In accordance with a preferred embodiment of the present invention, there is provided a game racket comprising:

a handle;

a frame extending from said handle; and a pair of planar surfaces mounted in said frame, at least one of said surfaces incorporating at least one shock-absorbing means for absorbing impact forces when hit by a ball.

In the preferred embodiment, the planar surfaces extending from the game racket handle are constructed in a sandwich design within a frame, with a set of coil springs compressed within the space defined between opposing surfaces. One of the surfaces is mounted to move within the frame against the springs such that it has a springy characteristic, while the other surface is stiff. In a racket ball game volley, either surface may be directed so that the ball impacts it. When the springy surface is directed toward the ball, it partially absorbs the impact force thereof, while the stiff surface does not. Thus, the inventive game racket enhances the player's ball control options in delivering the return volley.

An additional feature of the inventive game racket is the provision of an audio indication associated with impact of the ball on a particular area of the racket surface. A lamp and counter may also be provided for this purpose. By designating a particular area of the racket surface as the target, a player's expertise in achieving ball control accuracy can be measured.

The inventive racket affords an additional level of competitiveness to the existing racket ball sport, enabling development of new games with new play strategies and point scoring schemes. For example, if a targeted area of the racket has been designated, this may be used to provide a ball control accuracy measurement, with a player scoring extra points for each target hit recorded by the counter and/or the audio-visual signal.

Other features and disadvantages of the invention will become apparent from the following drawings and description.

BRIEF DESCRIPTION OF THE DRAWINGS

For a better understanding of the invention, reference is made to the accompanying drawings in which like numerals designate corresponding elements or sections throughout, and in which.

DETAILED DESCRIPTION OF A PREFERRED EMBODIMENT

Figure 1:
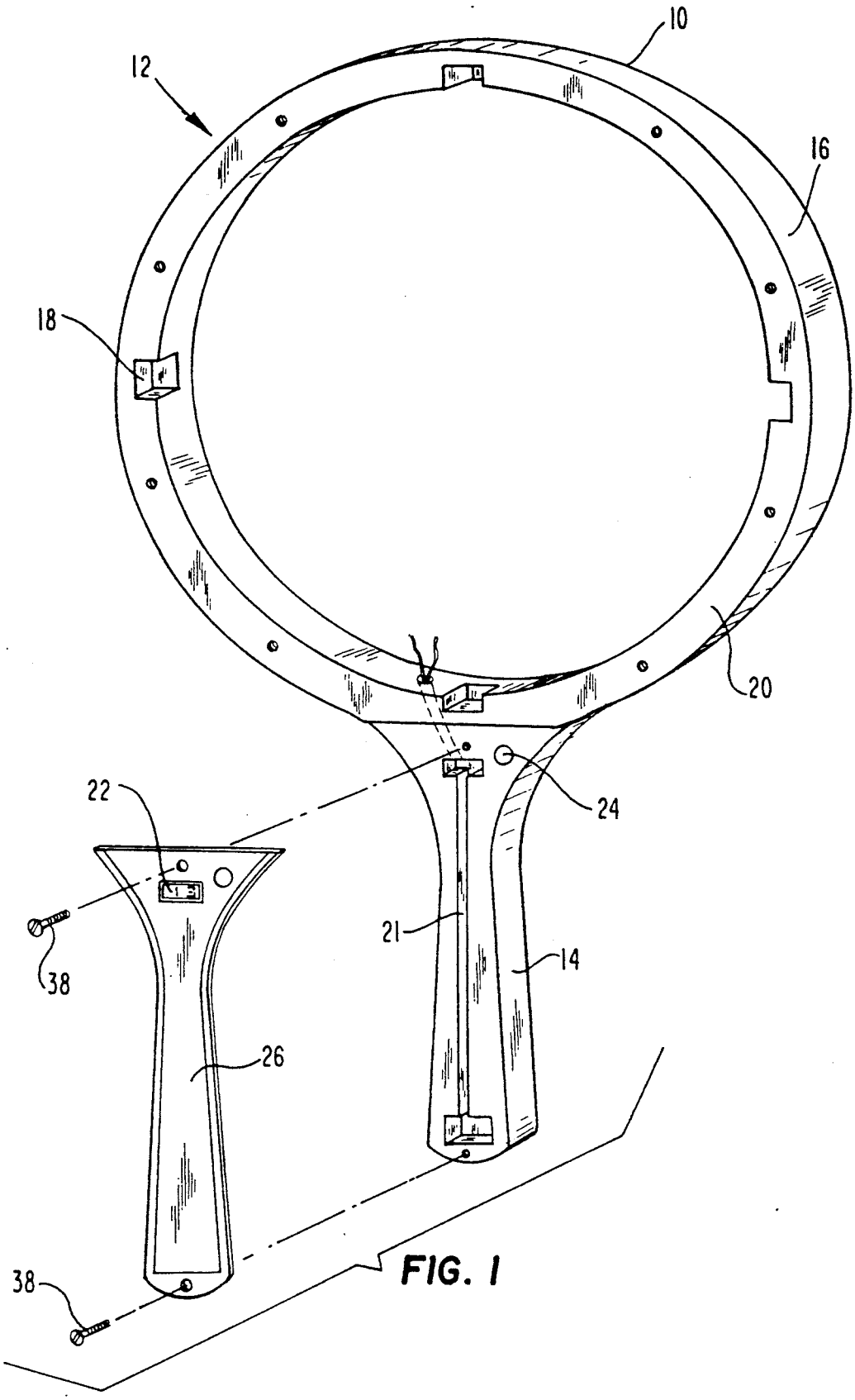
FIG. 1 is a front perspective view of a game racket frame constructed and operated in accordance with the principles of the present invention.

Referring now to FIG. 1, there is shown a front perspective view of a frame 10 for a shock-absorbing game racket 12 constructed and operated in accordance with the principles of the present invention. Frame 10 comprises a handle 14 and an upper portion 16 generally circular-shaped, designed to support ball contact surfaces (FIGS. 2–3) which are mounted therein and aligned via notches 18 formed on a front side 20 of frame 10. Frame 10 may have other geometrical shapes, e.g. square, ellipse.

Handle 14 is designed with a slot 21, in which wiring may be concealed for connection to electronic circuitry incorporating counter 22 and buzzer 24 or other audio device, as described further herein. Handle covers 26 attached on both sides of handle 14 cover slot 21 and provide handle gripping surfaces.

Figure 2:
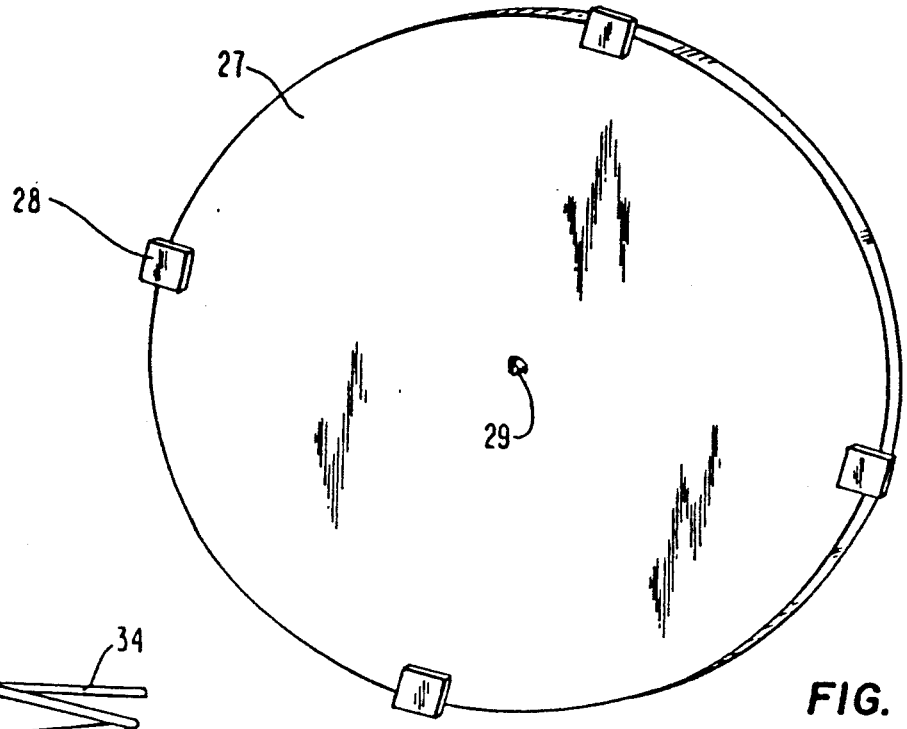
FIG. 2 is a perspective view of a surface of the racket which is assembled in the racket frame of FIG. 1.

FIG. 2 shows a ball contact surface 27 of racket 10, which has attached to its edges a plurality of mounting tabs 28, designed to fit into notches 18 to align surface 27 in frame 10. Notches 18 are formed with a depth which enables surface 27 to move perpendicular to its plane in frame 10, as tabs 28 move up and down and "float" in notches 18, as described further herein.

Also shown in FIG. 2 is a projection 29 at the center of the outer side of contact surface 27, for operating an electrical switch 30 mounted on its inner side. As further described herein, switch 30 is part of an electronic circuit for counting the number of target hits of the ball on the surface 27, as part of a novel game for scoring points.

In an alternative embodiment, multiple switches 30 may be provided in different areas of contact surface 27, such as on its outer periphery. Several areas may be designated, each having a different point value to improve the player's practice level.

Figure 4:
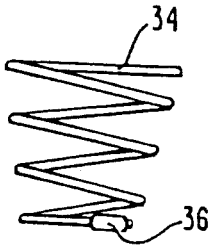
FIGS. 3–4 show, respectively, a perspective view of an opposing surface of the racket, and a shock-absorbing coil spring.
Figure 3:
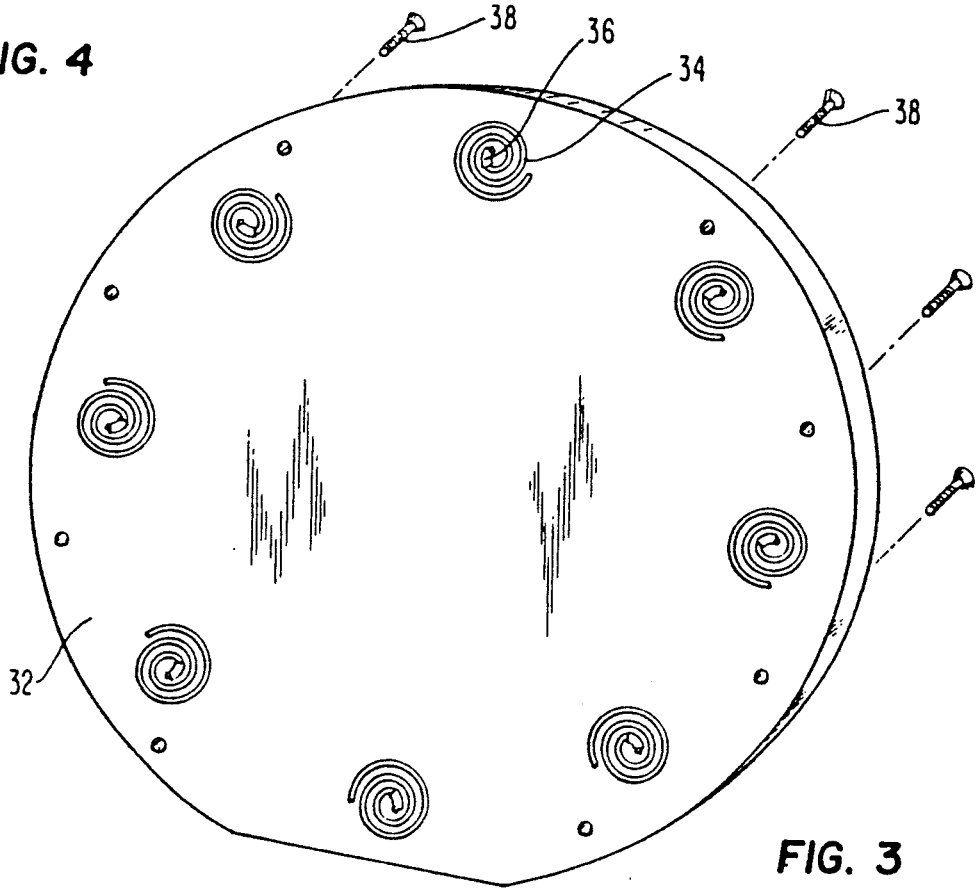

In FIGS. 3–4 there are shown, respectively, a ball contact surface 32 and a coil spring 34 used in providing racket 14 with a shock-absorbing characteristic in accordance with the principles of the present invention. A plurality of coil springs 34 is mounted on the inner side of surface 32, each being held in place by an attachment clamp 36 provided on the bottom of spring 34. Contact surface 32 is attached to racket frame 10 by mounting screws 38. Thus, contact surface 32 is stiff, while springs 34 push against contact surface 27, and surface 27 "floats" within frame 10, enabling it to absorb shocks on impact of a ball.

In an alternative embodiment, contact surface 32 is not attached to racket frame 10, and with appropriate modifications, can be arranged to float within notches 32. In this case, the conical shape of springs 34 affects the degree of stiffness/energy absorption each of the contact surfaces. This effect can also be achieved by variation of the thickness of the contact surface itself.

Figure 5:
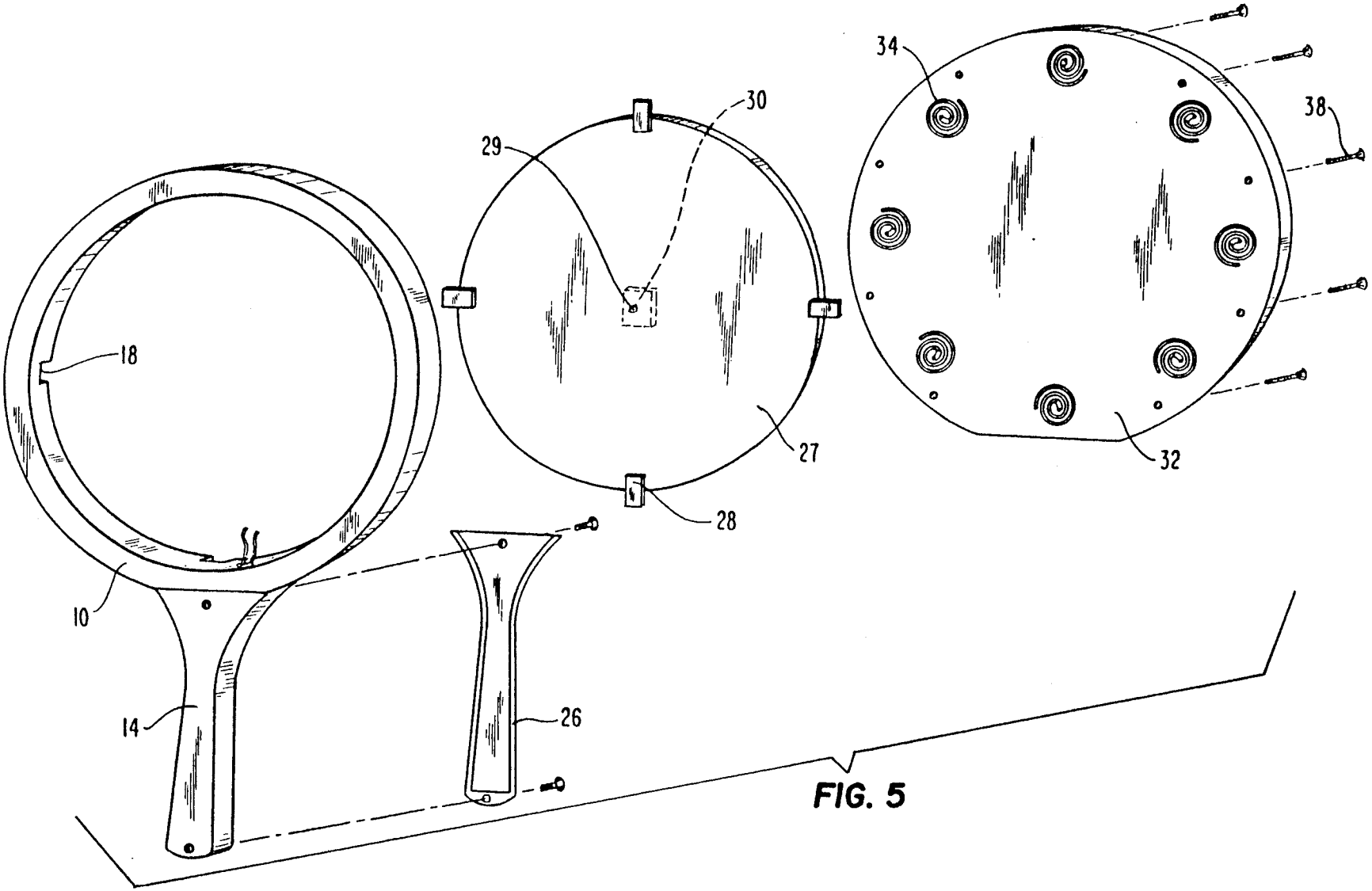
FIG. 5 is an exploded perspective view of the game racket assembly.

In FIG. 5, there is shown an exploded perspective view of the game racket 12 assembly, showing its overall construction. As shown, the front side 20 of racket 12 is oriented upward to allow insertion of contact surface 27 in frame 10, by aligning tabs 28 with notches 18. Handle covers 26 are attached to handle 14 with mounting screws 38.

Figure 6:
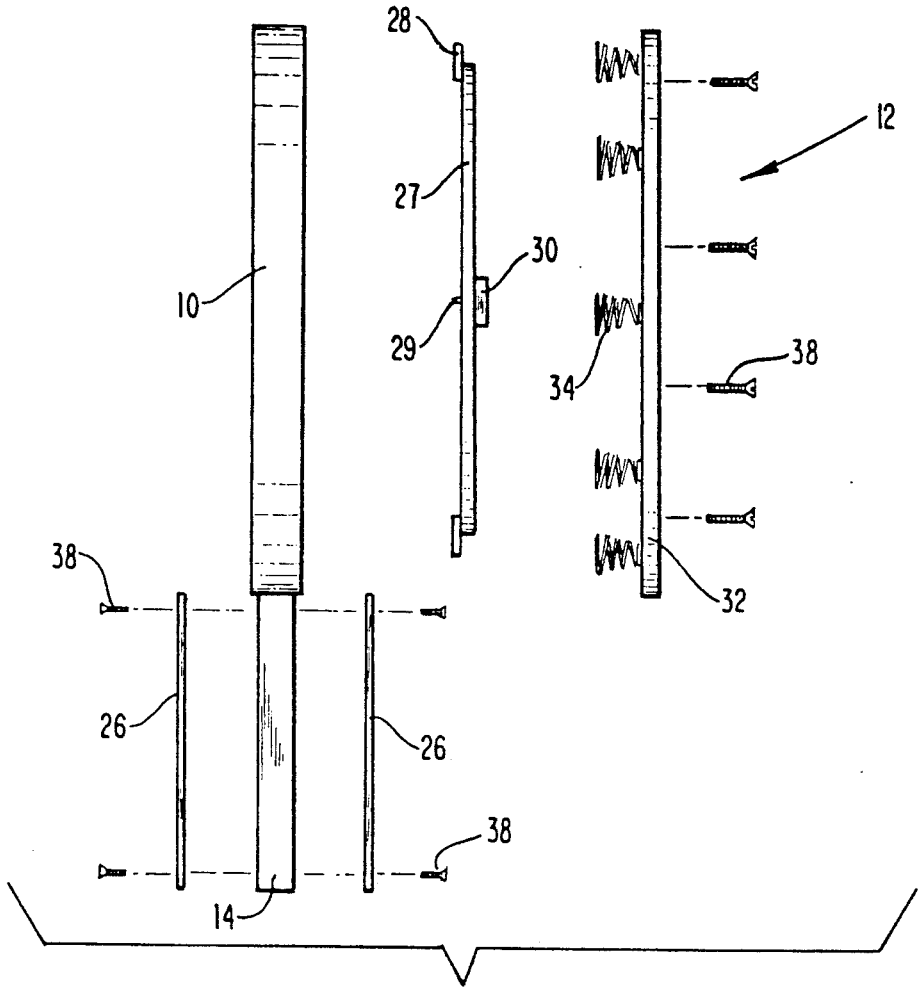
FIG. 6 is a side view of the racket assembly.

In FIG. 6, there is shown a side view of the racket assembly, illustrating the arrangement of coil springs 34 on the inner side of contact surface 32 against the inner side of contact surface 27, enabling surface 27 to "float" in notches 18.

Figure 7:
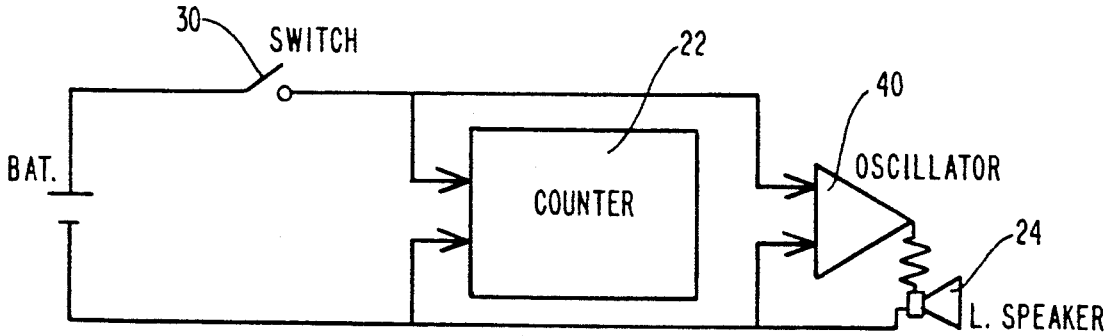
FIG. 7 is an electronic schematic of a target counter.

In FIG. 7, there is shown a block diagram of the electronic circuitry mounted in racket 12, enabling it to record the target impact hits of a ball on contact surface 27. When a ball hits the target area and activates electrical switch 30, counter 22 registers the event, which is displayed in handle 24. The same target impact also drives an oscillator 40, generating an audio output signal via loudspeaker or buzzer 24. Another indication may be given by an LED mounted in the racket handle 14.

In use, the shock-absorbing feature of game racket 12 provides a new aspect to the competitive nature of the racket ball game volley which can be maintained between players, or when the game racket is used by a single player for practice activity.

For a relatively hard ball impact force, if the player turns the racket so that it impacts the shock-absorbing contact surface 27, the rebound will be reduced, allowing the player to return the volley with a greater degree of control. The regular volley may be maintained by using the stiff contact surface 32. The characteristics of contact surfaces 27 and 32 of racket 10 enable the player to develop an individual style of play as needed. The player's ball control ability and choice of contact surface for playing also depends on the "bounciness" of the ball.

Each impact of the ball on the target area of contact surface 27 produces an audio indication, which registers on counter 22. If multiple target areas are designated and multiple switches are provided in racket 12, each switch may be assigned a different point value, producing a different audio frequency signal tone.

It will be appreciated that variations in the racket design are possible, including the elimination of the coil springs, while providing the electronic counter and tone features.

Having described the invention with regard to certain specific embodiments thereof, it is also to be understood that the description is not meant as a limitation, since further modifications may now suggest themselves to those skilled in the art, and it is intended to cover such modifications as fall within the scope of the appended claims.

We claim:

1. A game racket comprising:
a handle;
a frame extending from said handle; and
a pair of planar surfaces mounted in said frame, at least one of said surfaces incorporating at least one shock-absorbing means for absorbing impact forces when hit by a ball;
wherein said at least one shock-absorbing means comprises at least one coil spring disposed between said pair of planar surfaces.

2. The game racket of claim 1 wherein said at least one coil spring is conically-shaped.

3. The game racket of claim 1 wherein said at least one coil spring is cylindrically-shaped.

4. The game racket of claim 1 wherein said at least one shock-absorbing means comprises a plurality of coil springs disposed between said pair of planar surfaces.

5. The game racket of claim 1 wherein each of said pair of planar surfaces has at least one of a different thickness and a different material.

6. The game racket of claim 1 further comprising:
a power source;
an electrical switch activated on impact of said ball;
an electronic counter for recording switch activation;
an audio signal tone generator operated by said switch,
said counter and audio signal tone generator providing an indication to a player when said ball impact occurs.

7. The game racket of claim 6 wherein said planar surface defines at least one target area, and wherein said electrical switch is disposed in said at least one target area, so as to provide an indication when said ball impacts said target area.

8. The game racket of claim 7 wherein each of a plurality of said electrical switches is disposed in each of a plurality of said target areas, so as to provide a distinctive indication when said ball impacts said respective target area.

9. The game racket of claim 7 further comprising a light providing an indication when said ball impact occurs.

10. A game racket comprising:
a handle;
a frame extending from said handle;
a pair of planar surfaces mounted in said frame, at least one of said surfaces incorporating at least one shock-absorbing means for absorbing impact forces when hit by a ball, wherein said at least one shock-absorbing means comprises at least one coil spring disposed between said pair of planar surfaces;
a power source;
an electrical switch activated on impact of said ball;
an electronic counter for recording switch activation; and
an audio signal tone generator operated by said switch, said counter and audio signal tone generator providing an indication to a player when said ball impact occurs.

11. The game racket of claim 10 further comprising a light providing an indication when said ball impact occurs.

12. The game racket of claim 10 wherein said at least one coil spring is conically-shaped.

13. The game racket of claim 10 wherein said at least one coil spring is cylindrically-shaped.

14. The game racket of claim 10 wherein said planar surface defines at least one target area, and wherein said electrical switch is disposed in said at least one target area, so as to provide an indication when said ball impacts said target area.

15. The game racket of claim 14 wherein each of a plurality of said electrical switches is disposed in each of a plurality of said target areas, so as to provide a distinctive indication when said ball impacts said respective target area.

* * * * *

UNITED STATES PATENT AND TRADEMARK OFFICE

CERTIFICATE OF CORRECTION

PATENT NO. : 5,316,296

DATED : May 31, 1994

INVENTOR(S) : Liora B. BEN-ZIMRA et al

It is certified that error appears in the above-indentified patent and that said Letters Patent is hereby corrected as shown below:

On the title page, under item [19] and item [76], change "ZIRMA" to --ZIMRA--.

Signed and Sealed this

Thirteenth Day of December, 1994

*Attest:*

*Attesting Officer*

BRUCE LEHMAN

*Commissioner of Patents and Trademarks*